United States Patent [19]

Durand

[11] Patent Number: 4,465,998

[45] Date of Patent: Aug. 14, 1984

[54] BURGLAR-PROOF BARRIER

[75] Inventor: Pierre Durand, Clamart, France

[73] Assignee: Commissariat a l'Energie Atomique, Paris, France

[21] Appl. No.: 309,417

[22] Filed: Oct. 7, 1981

[30] Foreign Application Priority Data

Oct. 13, 1980 [FR] France ..... 80 21825

[51] Int. Cl.[3] ..... G08B 13/18

[52] U.S. Cl. ..... 340/557; 328/120; 340/512; 340/659; 340/825.64

[58] Field of Search ..... 340/556, 557, 659, 512, 340/815.3, 552, 825.64; 328/120

[56] References Cited

U.S. PATENT DOCUMENTS

| | | | |
|---|---|---|---|
| 2,984,789 | 5/1961 | O'Brien | 328/120 |
| 3,711,846 | 1/1973 | Schlisser et al. | 340/557 |
| 3,846,794 | 11/1974 | Lenay et al. | 340/527 X |
| 3,852,713 | 12/1974 | Roberts et al. | 340/512 |

FOREIGN PATENT DOCUMENTS

| | | |
|---|---|---|
| 1566733 | 4/1967 | Fed. Rep. of Germany . |
| 2455489 | 11/1974 | Fed. Rep. of Germany . |
| 2258639 | 8/1975 | France . |

*Primary Examiner*—David L. Trafton

*Attorney, Agent, or Firm*—Kerkam, Stowell, Kondracki & Clarke

[57] ABSTRACT

Burglar-proof barrier providing protection against intrusions, comprising means for the transmission of signals modulated and coded by pulses in a predetermined code, means for the reception of the modulated and coded signals transmitted and means for recognizing the predetermined code in the signals received, said recognition means supplying at an output a characteristic signal whenever the code is recognized, an alarm circuit whose input is connected to the output of the code recognition means and which supplies an alarm signal when the characteristic signal is absent, the code recognition means being constituted by a system of detecting pulses by coincidences and the modulated coded signals forming repeat pulse trains, wherein the system for the detection of pulses by coincidences comprises means for delaying, as from the first pulse in each train, all the pulses preceding the final pulse in the train in such a way as to bring them into coincidence with the latter, and a logic gate circuit for controlling these coincidences and which supplies the characteristic signal to an output forming the output of the detection system.

8 Claims, 3 Drawing Figures

BURGLAR-PROOF BARRIER

Figure 1:
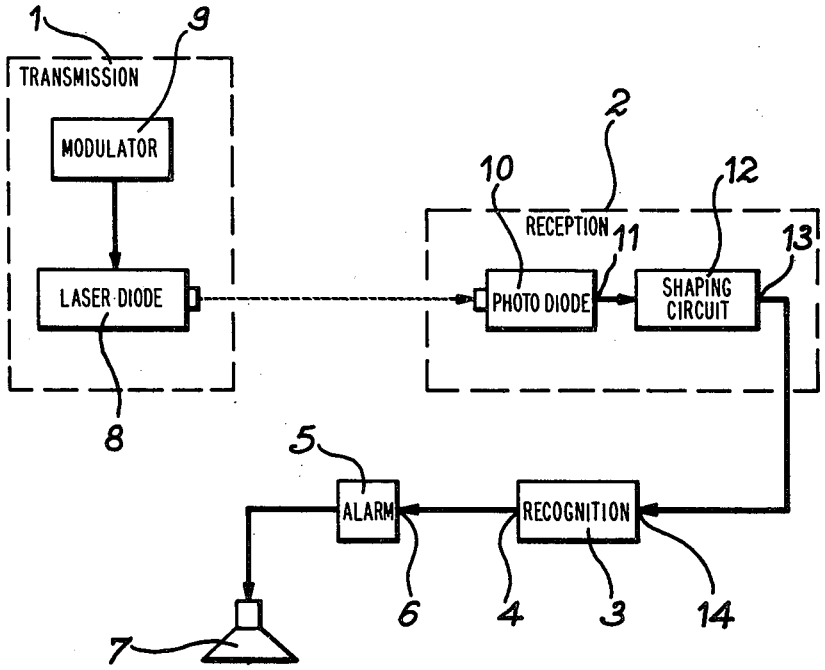

The present invention relates to a burglar-proof barrier to give protection against intrusion, trespass and burglary. The barrier is placed at the limit of the area to be protected and serves to detect any undesired intrusion into the said area.

For security reasons and in order to protect rooms or areas against undesired intrusions, protective barriers are being increasingly used. They are invisible to the intruder, but make it possible to set off an alarm when the intruder passes through the boundary of the area or room protected by the barrier. Protective barriers are known which comprise means for emitting signals modulated by pulses in a predetermined code. These signals are usually radio signals. These known barriers also comprise means for the reception of the modulated and coded signals emitted, as well as means for recognizing codes, which are linked with the reception means and at the output supply a characteristic signal on each occasion when the code is recognized. An alarm circuit is connected to these code recognition means. This circuit makes it possible to trigger off an alarm whenever the characteristic signal is absent at the output of the code recognition means, i.e. whenever the code is not recognized in the signals coming from the transmission means. Various more or less complicated code types are used for preventing an intruder from knowing the code. The reason is that anyone with the knowledge of the code could, if desired, replace the transmission or emission means located at the boundary of the area to be protected by "pirate" transmission or emission means supplying signals identical to those of the barrier transmission means in the direction of the reception means, which would enable the intruder to pass through the boundary without setting off the alarm. Moreover, existing barriers operating on the basis of radio signals are very subject to interference pulses and background noises, which trigger off the alarm in an untimely manner, so that such barriers are relatively unreliable. Finally, in these known barriers, the degree of complication of the codes used obviously leads to a high level of complication of the ligic coding circuits on transmission and the logic decoding circuits on reception.

The object of the invention is to obviate these disadvantages and to provide a burglar-proof barrier giving protection against intrusion functioning according to the same principle as the know barriers, but in which the transmitted code is very simple and is recognized by coincidence detection means making it impossible to replace the barrier transmission means by "pirate" transmission means. The use of this code recognition system based on the detection of pulses by coincidence effects also makes it possible to simplify the logic circuits used. Finally, the barrier according to the invention makes it possible to overcome the problems caused by background noise and interference in the barriers using radio signals, through the use of electromagnetic signals produced by a laser diode, e.g. of the infrared type. These problems are also solved through the use of a non-linear amplifier operating on an "all or nothing basis" from a threshold level which is above the peak level of the total noise (on reception and on amplification). This threshold, which is fixed by a comparator, must be adjusted as a function of the maximum temperature which can be accepted for the operation of the barrier (50° C.).

Therefore the present invention specifically relates to a burglar-proof barrier providing protection against intrusions, comprising means for the transmission of signals modulated and coded by pulses in a predetermined code, means for the reception of the modulated and coded signals transmitted and means for recognizing the predetermined code in the signals received, said recognition means supplying at an output a characteristic signal whenever the code is recognized, an alarm circuit whose input is connected to the output of the code recognition means and which supplies an alarm signal when the characteristic signal is absent, the code recognition means being constituted by a system of detecting pulses by coincidences and the modulated coded signals forming repeat pulse trains, wherein the system for the detection of pulses by coincidence comprises means for delaying, as from the first pulse in each train, all the pulses preceding the final pulse in the train in such a way as to bring them into coincidence with the latter, and a logic gate circuit for controlling these coincidences and which supplies the characteristic signal to an output forming the output of the detection system.

According to another feature of the invention the transmission means are constituted by a laser diode controlled by a coded pulse modulator and the reception means comprises a photodiode, whereof one output is connected to an amplification and shaping circuit, the output of this circuit constituting the output of the reception means.

According to another feature of the invention the transmission means are constituted by a coded electromagnetic pulse generator and the reception means comprise a receiver, whereof one output is connected to an amplification and shaping circuit, the output of said circuit constituting the output of the reception means.

According to another feature of the invention the alarm circuit comprises a monostable flip-flop for triggering off the alarm, whereof one input constitutes the input of the alarm circuit and whereof one output is connected to the input of a voltage threshold detection circuit, the duration of the conduction period of the monostable triggering flip-flop exceeding the duration of the interval separating two pulse trains, but being less than the sum of the duration of the two intervals, the output of the detection circuit supplying an alarm signal when the characteristic signal is absent, this absence causing the discontinuation of conduction of the monostable triggering flip-flop.

According to another feature the alarm circuit also comprises a minimum alarm maintainance monostable flip-flop connected between the output of the triggering flip-flop and the input of the threshold detection circuit, the conduction period duration of this alarm maintainance circuit making it possible to fix the minimum duration of the alarm signal.

According to another feature the alarm circuit also comprises a logic gate with two inputs, which are respectively connected to the outputs of the triggering flip-flop and the minimum maintainance flip-flop, the output of said gate being connected to the threshold detector input in such a way that the duration of the alarm signal is equal to the duration of the intrusion, when the latter has a duration exceeding that of the conduction of the minimum alarm maintainance flip-flop.

According to another feature the means for delaying the pulses comprise a counter, whereof one input receives the pulses of each train and whereof the outputs are respectively connected to the inputs of circuits making it possible to respectively delay the pulses of each train in order to make them coincide with the final pulse of the train, another input of the counter being connected to a resetting and resetting maintainance logic circuit, which is able to bring about and maintain the resetting of the counter, immediately following each coincidence detection, however two successive pulse trains.

The invention is described in greater detail hereinafter relative to non-limitative embodiments and the attached drawings, wherein show:

FIG. 1 diagrammatically a barrier according to the invention.

Figure 2:
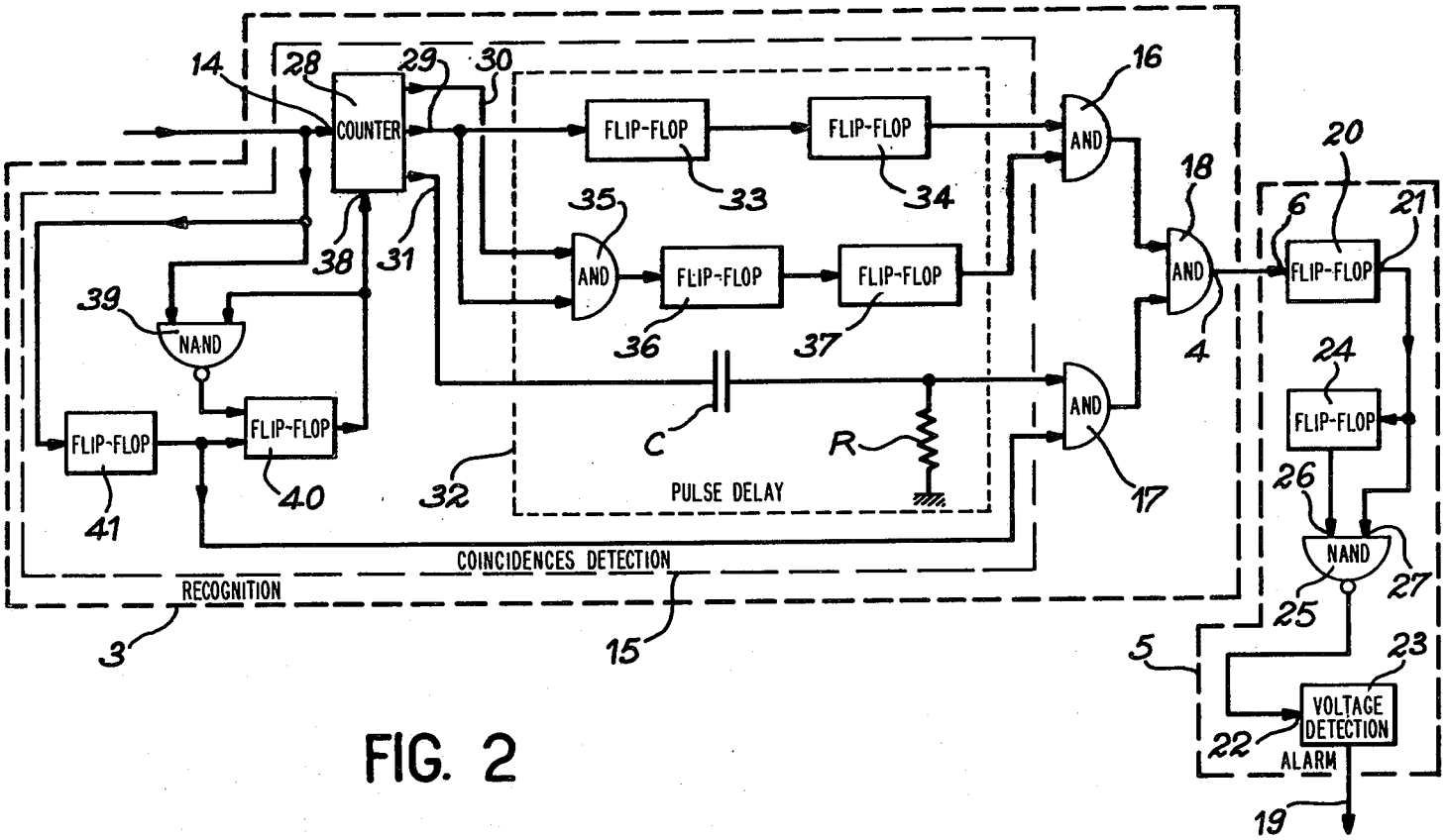

FIG. 2 diagrammatically, but in a more detailed manner, the code recognition means and alarm circuit of the barrier according to the invention.

Figure 3:
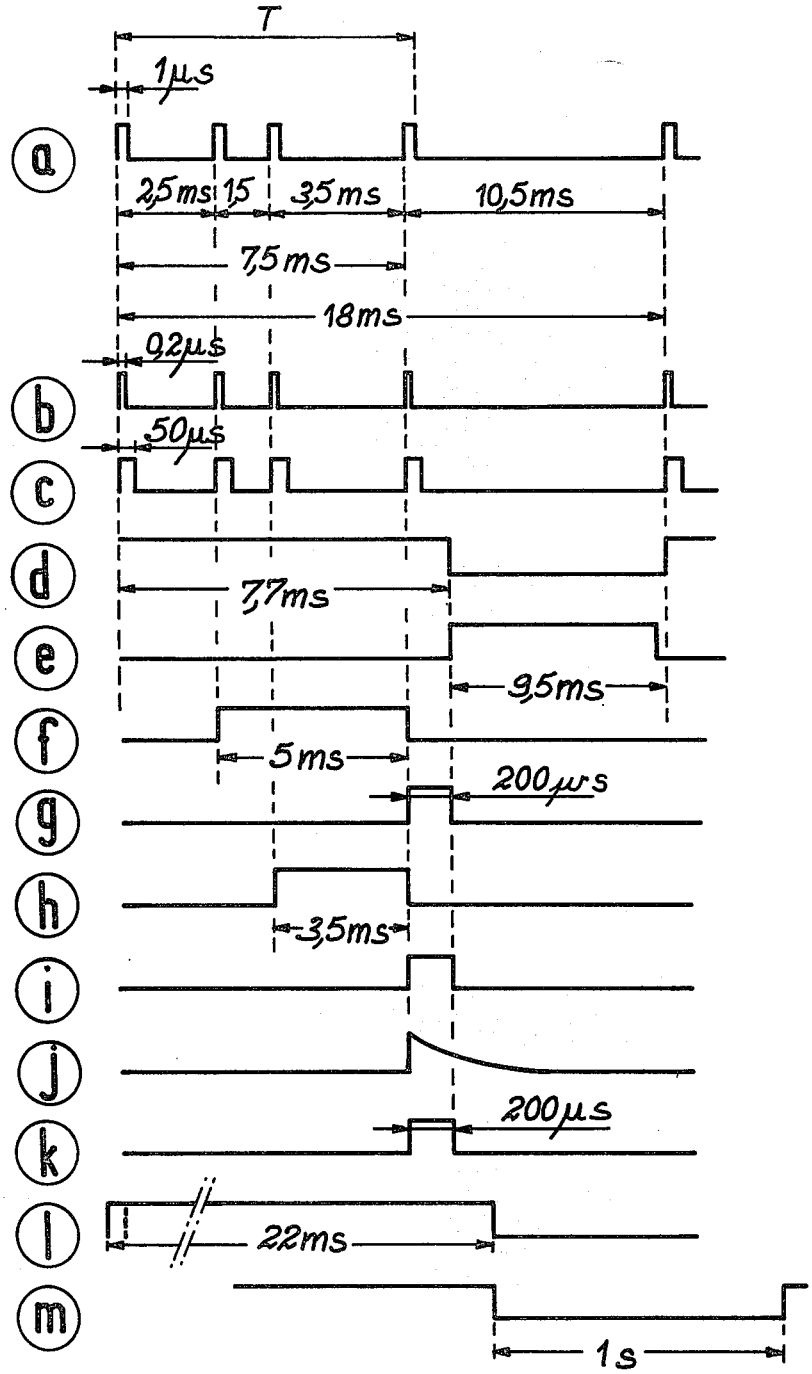

FIG. 3 a chronogram of the different signals appearing at characteristic points of the reception means of the barrier according to the invention.

FIG. 1 diagrammatically shows in block form a burglar-proof barrier for providing protection against intrusions in accordance with the present invention. This barrier comprises means 1 for the transmission of signals modulated and coded by pulses in a predetermined code and means 2 for the reception of the modulated and coded signals transmitted. Means 3 connected to the reception means 2 make it possible to recognize the predetermined code in the signals received and supply at an output 4 a characteristic signal whenever the transmission code is recognized. An alarm circuit 5, whereof one input 6 is connected to the output 4 of the recognition means 3, supplies an alarm signal when the characteristic signal is absent at its input 6. At 7 is diagrammatically shown a sound alarm, butit is obvious that the alarm could be e.g. of a visual nature.

As will be shown hereinafter the code recognition means 3 are constituted by a system for the detection of pulses by coincidences. According to the invention the transmission means 1 are constituted by a laser diode 8 shown diagrammatically in FIG. 1. This laser diode is controlled in per se known manner by a coded pulse modulator 9. The reception means comprise a photodiode 10 whereof one output 11 is connected in per se known manner to an amplification and shaping circuit 12. The output of the latter circuit forms the output of the reception means. Preferably laser diode 8 is an infrared diode, whilst photodiode 10 is sensitive to the wavelengths corresponding to the infrared range. The amplification and shaping circuit 12 is known in the art and will not be described in detail. It is preferably constituted by a non-linear amplifier operating on an "all or nothing basis" from a threshold level above the peak level of the total noise (on reception and amplification). This threshold which is fixed by a comparator must be adjusted as a function of the maximum acceptable operating temperature for the barrier (50° C.).

FIG. 2 diagrammatically shows in greater detail the code recognition means 3 and the alarm circuit 5. As stated hereinbefore the code recognition means 3 comprise a system for the detection of pulses by coincidence. At its input 14 this system receives modulated, coded signals from the pulse shaping and amplification means 12 (not shown). These modulated, coded signals are formed by repeat pulse trains.

The system for the detection of pulses by coincidences comprises means 15 making it possible, in the manner shown hereinafter, to delay, as from the first pulse of each train, all the pulses preceding the final pulse of said train so as to make them coincide with the latter. This system also comprises a circuit with logic AND gates 16, 17, 18 making it possible to control the coincidences. At its output 4 this circuit supplies in the case when the delayed pulses coincide, the characteristic signal referred to hereinbefore, which is applied to the input 6 of alarm circuit 5. As will be shown in greater detail hereinafter the absence of the characteristic signal leads to the appearance of an alarm signal at output 19 of alarm circuit 5 causing the setting off of alarm 7 (FIG. 1, but not shown in FIG. 2).

Alarm circuit 5 comprises an alarm triggering monostable flip-flop 20, whose input 6 constitutes the input of the alarm circuit. One output 21 of flip-flop 20 is connected to an input 22 of a voltage detection circuit 23, whereof the output 19 forms the output of alarm circuit 5. This threshold detector may be constituted, for example, by a relay. The duration of the conduction period of monostable flip-flop 20 exceeds the duration of the interval separating two pulse trains (time interval between the first pulse of a train and the first pulse of the following train) received by the code recognition means 15, whilst still being less than the sum of the duration of two intervals. The output 19 of the voltage threshold detection circuit 25 supplies an alarm signal when the characteristic signal of a coincidence is absent at the output of code recognition circuit 3.

As will be shown hereinafter this absence leads to the stopping of the conduction of flip-flop 20 and triggers off alarm 7 (FIG. 1). Alarm circuit 5 also comprises a minimum alarm maintainance monostable flip-flop 24 connected between the output 21 of triggering flip-flop 20 and input 22 of the threshold detection circuit 23. As will be shown hereinafter the duration of the conduction period of the alarm maintainance flip-flop makes it possible to fix the duration of the minimum alarm signal applied to threshold detector 23. Finally, alarm circuit 5 also comprises a logic NAND gate 25 with two inputs 26, 27, respectively connected to the outputs of triggering flip-flop 20 and minimum maintainance flip-flop 24. The output of this gate is connected to the input 22 of threshold detector 23. The association of flip-flops 20 and 24 and logic gate 25 makes it possible to fix the duration of the alarm when the intrusion is of short duration or to maintain this alarm throughout the intrusion period if the latter exceeds the conduction period of the minimum maintainance flip-flop 24.

The means 15 making it possible to delay the pulses comprise a counter 28, whereof the input 14 receives the pulses of each train and whereof the outputs 29, 30, 31 are respectively connected to the inputs of circuits 32 making it possible to respectively delay the pulses of each train in order to make them coincide with the final pulse of the train. The first of these circuits makes it possible to delay the second pulse of each train. For example it comprises a first monostable flip-flop 33 able to delay the second pulse so as to make it coincide with the final pulse of the train. This first monostable flip-flop is followed by a second monostable flip-flop 34, which shapes the delayed pulse. The second of these circuits which comprises, for example, an AND gate 35 followed by a first monostable flip-flop 36, makes it possible to stagger the third pulse of the train so as to make it coincide with the final pulse of said train. This time lag is applied by a monostable flip-flop 36, whereof the output is connected to the input of another shaping monostable flip-flop 37.

As will be shown hereinafter it is assumed that the pulse trains respectively have four pulses, but this number is in no way limitative. The delay networks 32 comprise a shunt circuit C, R on the fourth pulse, so as to limit its effectiveness period to approximately 200 μs in order to form in this way the final coincidence signal. This fourth pulse does not have to be delayed.

Another input 38 of counter 28 is connected to a resetting and resetting maintainance logic circuit comprising, for example, the NAND gate 39 and monostable flip-flops 40, 41.

As will be shown hereinafter the logic circuit makes it possible to reset counter 28 and maintain this state immediately after each coincidence detection. The counting time is fixed by the duration of the conduction period of monostable flip-flop 41, whilst flip-flop 40 maintains the counter resetting immediately after each coincidence detection between two successive pulse trains.

FIG. 3 is a chronogram of the signals present at certain characteristic points of the barrier according to the invention. Study of this chronogram gives a better understanding of the operation of said barrier.

Diagram a therein represents successive pulse trains T supplied by the transmission means 1 of FIG. 1.

In the embodiment described in exemplified manner it is assumed that the transmission means supply successive pulse trains T of in each case four pulses, each pulse lasting one μs of each pulse being separated by the time intervals indicated in the drawing. It is also assumed that the pulse trains follow one another every 18 ms and that the time separating the final pulse of one train from the first pulse of a following train is equal to 10.5 ms.

Diagram b represents the pulse trains received by reception means 2. It is assumed that no intrusion has taken place and that no interference pulse has interfered with the barrier. This diagram represents the pulses and the output of photodiode 10. For example they last 0.2 μs, which increases to 0.6 μs at the amplifier output and prior to shaping.

Diagram c represents the pulses at the output of the amplification and shaping means 12. Each of these pulses lasts e.g. 50 μs.

Diagram d represents the output signal of monostable flip-flop 41. This signal makes it possible to fix the pulse counting time and also makes it possible to determine the coincidence eftects, in the manner described hereinafter. If there is no interference this signal lasts e.g. 7.7 ms. It makes it possible to determine coincidences in a square-wave pulse of 200 μs having a time lag of 7.4 ms compared with the rise of the first pulse of the train.

Diagram e represents the output signal of monostable flip-flop 40. This signal has a high level when interference is absent, lasts 9.5 ms and makes it possible to maintain the resetting of the counter during this period. Monostable flip-flop 40 is triggered by the combination of the output signal of flip-flop 41 and the output signal of the NAND gate 39.

Diagram f represents the output signal of monostable flip-flop 33. In the present embodiment this signal lasts 5 ms corresponding to the time lag applied to the second pulse of train T.

Diagram g represents the second delayed pulse after its shaping in monostable flip-flop 34. This delayed pulse has a duration of 200 μs and is applied to one of the inputs of AND gate 16 of the coincidence control logic circuit.

Diagram h represents the output signal of monostable flip-flop 36. This signal lasts 3.5 ms and represents the time lag applied to the third pulse of train T.

Diagram i represents the third pulse of train T at the output of monostable flip-flop 37 and which shapes the said pulse delayed by flip-flop 36. This third shaped pulse has a duration of 200 μs and is applied to the other input of gate 16 of the coincidence control circuit 16, 17, 18.

Diagram j represents the output signal of shunt circuit R, C and represents the derivative relative to time of the fourth and final pulse of the train. This pulse is not delayed and is instead merely shaped, because the coincidences are determined from the rising fronts of the said last pulse.

According to the invention the last pulse is processed by a shunt circuit in such a way that this pulse is not subject to any parasitic delay. The output signal of this circuit is applied to one of the inputs of the AND gate 17 of the coincidence control circuit. The other input of the AND gate receives the output signal from monostable flip-flop 41, i.e. the signal represented on diagram d. If coincidence exists between the different pulses of the train which have been delayed and processed in the indicated manner, the output signals of the AND gates 16 and 17 are at a high level. These signals are applied to gate 18 of the coincidence-control circuit which, in the case of coincidence, supplies a characteristic signal lasting 200 μs as represented in diagram k.

When all the coincidences are obtained a characteristic signal, like that shown in diagram k, is supplied by the coincidence control circuit to the monostable flip-flop 20 of alarm circuit 5. This flip-flop, which has a conduction period of 22 ms exceeding the duration of the interval between two pulse trains, but less than the sum of the durations and the two intervals, i.e. 18 ms$<$22 ms$<$2$\times$18 ms, then has an output, whose signal continuously remains at a high level (logic level 1), whilst the output of the alarm maintainance flip-flop 24 also remains at a high level. Thus, at the output of the NAND gate 25, the logic signal is at a low level (level 0). This low level signal is applied to relay 23, which is kept held down. If, however, an intrusion of very short duration occurs between the transmission and reception means, no coincidence signal is applied to output 4 of the coincidence control logic circuit. The output 21 of the triggering monostable flip-flop 20 then passes from level 1 to level 0 and the output signal from AND gate 25 passes to level 1, which releases relay 23 and sets of alarm 7. In the case of any short interference, the output signal of NAND gate 25 is kept at a high level for a time fixed by the conduction time of the minimum maintainance flip-flop 24. For example this time is equal to one second and the output signal of said flip-flop is in this case represented in diagram 1. It is assumed in this case that there were no pulse coincidences in the considered train and that the output signal of the alarm triggering flip-flop 20, instead of remaining at a high level, dropped to a low level 22 ms after the appearance of the first pulse of the train and as shown in diagram 1.

When the interference time exceeds 1 second, the output signal of the alarm triggering flip-flop 21 remains at level 0 throughout the duration of the interference. As a result the output signal of the NAND gate 25 remains at level 1 throughout this period, although at its input 26 this gate has received a level 1 signal lasting 1 second. In this case throughout the interference time, relay 23 receives a level 1 signal making it possible to trigger off the alarm throughout this period.

The barrier described hereinbefore makes it possible to achieve the indicated objectives. Thus, any parasitic pulse entering the pulse train or any suppression of pulses of the code leads to a displacement in the count time and interferes with the concidences, so that an alarm is given. The monostable flip-flops and other components used in the barrier according to the invention have not been described in detail. The components such as flip-flops, diodes, photodiodes, etc. are known and commercially available.

The barrier according to the invention is able to detect intrusions between two points 1,000 meters apart.

Instead of using a laser diode on transmission and a photodiode on reception, it is possible to use a coded electromagnetic pulse generator and a receiver able to detect these pulses.

I claim:

1. A burglar-proof barrier providing protection against intrusions, comprising means for the transmission of signals modulated and coded by pulses in a predetermined code, means for the reception of the modulated and coded signals transmitted and means for recognising the predetermined code in the signals received, said recognition means supplying at an output a characteristic signal whenever the code is recognized, an alarm circuit whose input is connected to the output of the code recognition means and which supplies an alarm signal when the characteristic signal is absent, the code recognition means being constituted by a system of detecting pulses by coincidences and the modulated coded signals forming repeat pulse trains, wherein the system for the detection of pulses by coincidences comprises means for delaying, as from the first pulse in each train, all the pulses preceding the final pulse in the train in such a way as to bring them into coincidence with the latter, and a logic gate circuit for controlling these coincidences and which supplies the characteristic signal to an output forming the output of the detection system.

2. A barrier according to claim 1, wherein the alarm circuit comprises a monostable flip-flop for triggering off the alarm, whereof one input constitutes the input of the alarm circuit and whereof one output is connected to the input of a voltage threshold detection circuit, the duration of the conduction period of the monostable triggering flip-flop exceeding the duration of the interval separating two pulse trains, but being less than the sum of the duration of the two intervals, the output of the detection circuit supplying an alarm signal when the characteristic signal is absent, this absence causing the discontinuation of conduction of the monostable triggering flip-flop.

3. A barrier according to claim 2, wherein the alarm circuit also comprises a minimum alarm maintainance monostable flip-flop connected between the output of the triggering flip-flop and the input of the threshold detection circuit, the conduction period duration of this alarm maintainance circuit making it possible to fix the minimum duration of the alarm signal.

4. A barrier according to claim 3, wherein the alarm circuit also comprises a logic gate with two inputs, which are respectively connected to the outputs of the triggering flip-flop and the minimum maintainance flip-flop, the output of said gate being connected to the threshold detector input in such a way that the duration of the alarm signal is equal to the duration of the intrusion, when the latter has a duration exceeding that of the conduction of the minimum alarm maintainance flip-flop.

5. A barrier according to claim 1, wherein the means for delaying the pulse comprise a counter, whereof one input receives the pulses of each train and whereof the outputs are respectively connected to the inputs of circuits making it possible to respectively delay the pulses of each train in order to make them coincide with the final pulse of the train, another input of the counter being connected to a resetting and resetting maintainance logic circuit, which is able to bring about and maintain the resetting of the counter, immediately following each coincidence detection, between two successive pulse trains.

6. A barrier according to claims 1, 2, 3, 4 or 5 wherein the amplification and shaping circuit comprises a non-linear amplifier functioning on an "all or nothing basis", from a threshold level above the peak level of the total noise on reception and amplification, said threshold being fixed by a comparator and being adjusted as a function of the maximum temperature acceptable for the operation of the barrier.

7. A barrier according to claims 1, 2, 3, 4 or 5 wherein the transmission means are constituted by a laser diode controlled by a coded pulse modulator and the reception means comprises a photodiode, whereof one output is connected to an amplification and shaping circuit, the output of this circuit constituting the output of the reception means.

8. A barrier according to claims 1, 2, 3, 4 or 5 wherein the transmission means are constituted by a coded electromagnetic pulse generator and the reception means comprise a receiver, whereof one output is connected to an amplification and shaping circuit, the output of said circuit constituting the output of the reception means.

* * * * *